US006260945B1

(12) United States Patent
Niikura

(10) Patent No.: US 6,260,945 B1
(45) **Date of Patent: *Jul. 17, 2001**

(54) RECORDING APPARATUS AND METHOD FOR CONTROLLING SCANNING SPEEDS OF THE RECORDING HEAD OF SUCH RECORDING APPARATUS

(75) Inventor: Takeji Niikura, Kawasaki (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/531,342

(22) Filed: Sep. 20, 1995

(30) Foreign Application Priority Data

Sep. 22, 1994 (JP) ..... 6-254598

(51) Int. Cl.[7] ..... B41J 23/00

(52) U.S. Cl. ..... 347/37; 347/19; 347/32; 400/279

(58) Field of Search ..... 347/32, 37, 39, 347/5, 19, 323, 323.1, 171, 218; 400/323, 279, 320, 322, 283; 395/105

(56) References Cited

U.S. PATENT DOCUMENTS 4,692,777 * 9/1987 Hasumi ..... 347/30
5,485,178 * 1/1996 Tateyama et al. ..... 347/5

FOREIGN PATENT DOCUMENTS 52-57732 * 5/1977 (JP) ..... 400/322
57-4775 * 1/1982 (JP) ..... 400/322

* cited by examiner

*Primary Examiner*—N. Le
*Assistant Examiner*—Shih-Wen Hsieh
(74) *Attorney, Agent, or Firm*—Fitzpatrick, Cella, Harper & Scinto

(57) ABSTRACT

A recording apparatus is capable of making the scanning range of a carriage narrower without expanding the left and right recording blanks of a recording material, and further, making the apparatus smaller without lowering the quality of recorded images, as well as enhancing the throughput thereof. To provide such apparatus, it is arranged to control the traveling speeds of a recording head in recording areas, and then, to determine the traveling speeds thereof in accordance with the distance between the stop position and the position to start recording, the distance between the position to terminate recording and the stop position, as well as with the contents to be recorded on a given line, among others.

42 Claims, 11 Drawing Sheets

α : ACCELERATION AND DECELERATION AREA

β : LEFT BLANK RECORDING

γ : RIGHT BLANK RECORDING

RECORDING APPARATUS AND METHOD FOR CONTROLLING SCANNING SPEEDS OF THE RECORDING HEAD OF SUCH RECORDING APPARATUS

BACKGROUND OF THE INVENTION

1. Field of the Invention

The present invention relates to a recording apparatus for recording by causing recording means to reciprocate to correlatively scan on a recording material. A printer of the kind, the so-called serial printer, repeats the main scanning where recording means reciprocate to scan, and the sub-scanning where a recording material is carried in the direction rectangular to the main scanning direction for the performance of recording.

2. Related Background Art

A recording apparatus provided with the functions of a printer, copying machine, facsimile apparatus, and the like or a recording apparatus used as output equipment for a complex machine including a computer, a wordprocessor, or the like, or for a work station is structured to record images (including characters, symbols, and the like) on a recording material (recording medium) such as a recording sheet, a thin plastic plate (OHP sheet or the like) in accordance with image information. Depending on the recording means to be adopted, the recording apparatuses are divided into those using an ink jet method, a wire-dot method, a thermo-sensitive method, a laser beam method, among others.

In a recording apparatus of a serial type that adopts a recording method whereby to conduct its main scanning in the direction in the carrying direction of a recording material (sub-scanning direction), images (including characters, symbols, and the like) are recorded by use of recording means installed on a carriage that travels (scans) along the recording material after the recording material is set at a given recording position. After one line portion has been recorded, the sheet is fed (sub-scanned) for a given amount, and then the images on the next line are recorded by means of the main scanning. By repeating such operation, images are recorded in a desired area on the recording material. On the other hand, in a recording apparatus of a line type where recording is executed only by sub-scanning to carry a recording material in the carrying direction, the recording material is set at a given recording position, and then, the sheet feeding is conducted for a given amount (pitch fed), while a one-line portion is being recorded continuously altogether, thus recording images on the entire area of the recording material.

Of the aforesaid recording methods, the ink jet method (an ink jet recording apparatus) is the one that records by discharging ink from recording means recording head) onto a recording material, thus making it easier to fabricate recording means compactly, and to record highly precise images at high speeds. This method also makes it possible to record on an ordinary sheet without any special treatments given to it, leading to lower running costs. Being non-impact, the method makes lesser noises when the apparatus is in operation. Also, among other advantages, it is easier for this method to record images in color using ink of multiple colors. Particularly, it is possible to attain a higher speed recording by use of a recording apparatus of a line type that uses a line type recording means where many numbers of discharge ports are arranged in the sheet width direction.

Here, recording means (recording head) using an ink jet method, in which ink is discharged by utilization of thermal energy, makes it possible to easily fabricate the recording means provided with a highly densified arrangement of liquid paths (arrangement of discharge ports) by providing electro-thermal transducing elements, electrodes, walls for liquid paths, a ceiling board, and others on a base board by means of film formation technologies, which include etching, deposition, sputtering, or other semiconductor fabrication processes. Consequently, the recording means is made more compact. Also, by utilizing the advantages of IC technologies and micro-machining techniques, it becomes easier to elongate and surface the recording means (to make it two-dimensional), facilitating the provision of a multiple recording means, and the performance of a highly densified assembling thereof. Meanwhile, there are various demands on the materials of recording media. In recent years, there have been demands on use of thin papers and processed papers (such as punched sheets for filing use, scored sheets, arbitrarily shaped sheets) in addition to the sheet papers and thin plastic plates that are usually used.

In the recording apparatus of a serial type, a recording material is set at a given position. After that, images are recorded (main scanned) by driving the recording head in accordance with recording information while causing the recording head (recording means) installed on a carriage to travel along the recording material by use of a carriage motor as described above. After the completion of one line recording, the sheet is carried (by pitches) for a given amount by the rotation of a carrier roller driven by a carrier motor, and then, the images on the next line are recorded (main scanned). Such operation is repeated to record images on a recording material.

FIG. 10 is a velocity chart which shows the controlled conditions of acceleration and deceleration of a carriage motor generally used, and the actual motion of a carriage as well. In FIG. 10, the axis of ordinate represents the speeds V, and the axis of abscissa represents the positions P of the carriage. Also, in FIG. 10, the reference mark m1 designates the control of the carriage motor in recording operation in the normal mode. A reference mark m2 designates the control thereof in the draft mode where it operates at a higher speed than that in the normal mode. An area L1 is the acceleration area, while an area L3 is the deceleration area. Also, an area L2 is the recording area where recording is performed while the carriage travels. In this recording area L2, the carriage is arranged to travel at a constant speed so as to execute a high quality recording. In each of the modes ml and m2, the solid line CL represents the controlled speed of the carriage motor, while the two-dot chain line MV represents the actual movement of the carriage when it is controlled as in the condition represented by the solid line CL.

In the normal dot recording operation represented by the reference mark ml, the carriage motor is not out of step due to the controlled acceleration and deceleration. Thus it is driven to effectuate the scanning of the recording area L2 at a speed V1. Here, the draft mode is generally known as a recording mode whereby to attain low running costs by enhancing recording speeds only for the purpose of a test printing or the like, although the quality of recorded images is inevitably lowered. In FIG. 10, the draft mode represented by the reference mark m2 is such that the recording speed is enhanced two times (as shown at $2V_1$ in FIG. 10) with the execution of a recording by thinning out the recording dots by 50%. In this draft mode, it is difficult to set sufficient acceleration and deceleration areas because of the limited size of an apparatus. Therefore, an acute acceleration is needed. For that matter, even if the driving of the carriage motor is controlled so that the scanning may be performed at a constant speed after such acceleration, the actual movement of the carriage also results in the varied speeds in the recording area L2 shown in FIG. 10. This produces an adverse effect on the quality of recorded images, but being employed for the purpose of test printing or the like, the recording is carried out in this mode with the understanding of the user that the higher speeds are only obtainable at a slight sacrifice of the quality of recorded images.

FIG. 11 is a velocity chart which shows one example of recording control by the application of the conventional technique. The axes of ordinate and abscissa in FIG. 11 also represent speeds V and carriage positions P as in FIG. 10. A reference mark L2 designates a recording area as in FIG. 10. Here, a reference mark L4 designates a non-recording area (skipping portion). As shown in FIG. 11, the scanning speed of the carriage is enhanced in this area. It is intended to shorten the total time required for recording by increasing the main scanning speed in the non-recording area, while making the scanning speeds constant in the recording area as shown in FIG. 11, so as to effectuate a control for the performance of a skipping operation to make the period of main scanning shorter.

FIG. 12 is a view which schematically shows the factors required to determine the width of a recording apparatus. In FIG. 12, a reference numeral 1 designates a recording head; 1A, the recording unit of the recording head 1; HL, the width of the recording head; and 80, a recording material for recording to be made on. Also, a reference mark ML designates the width of an apparatus; RL, a recording width; $\alpha$, the acceleration and deceleration areas; $\beta$, the left recording blank on a recording material; and $\gamma$, the right recording blank of the recording material. Also, a reference numeral 1' designates a position where the recording head travels to the right hand side in FIG. 12 by means of the carriage scan.

It is desirable to make an arrangement so that the acceleration of the carriage terminates, and then, scanning is conducted at a constant speed when the recording head 1 is caused by the carriage to scan, and the recording unit 1 arrives in the recording width RL. As shown in FIG. 12, the width of the recording apparatus (apparatus width) ML is determined by the factors such as the recording width RL, the acceleration and deceleration areas a (including the constant area to stabilize the head traveling), and the width of the recording head HL. However, in the conventional art, there is a need for the stabilized driving of a motor in order to obtain a high quality in recorded images. Therefore, it is necessary to make wider the acceleration and deceleration areas at L1 and L3 in FIG. 10.

Also, regarding the recording blanks (recording width), it is usual that the left and right blanks are set at approximately 15 to 20 mm each for most of the general documents. For a printer, however, a measure is required to enable a blank to be set at as narrow as 5 mm due to occasional uses of the printer for some other special purposes. In addition to the provision of such area that may be needed occasionally, the acceleration and deceleration areas are required as described above. As a result, it is inevitable that the size of the apparatus is made larger. However, this kind of technique is rather against the trend in making the recording apparatuses smaller in recent years to meet the increasing demands on personal computers, wordprocessors, or the like, which should be more suitable for personal uses. Further, in order to solve problems of this kind, it is arranged, in some cases, to make the recording width narrower for the purpose of making the apparatus smaller; to slow down the scanning speeds in order to make the acceleration and deceleration areas smaller; or to perform recording before the stabilized driving is reached at a sacrifice of the quality of recorded images. This sort of arrangement does not present any fundamental solution of the problem described above. With such an approach as this, it is utterly difficult to obtain the user's satisfaction, of course.

SUMMARY OF THE INVENTION

In consideration of the problem described above, the present invention is designed. It is an object of the invention to provide a recording apparatus capable of making the scanning area of a carriage narrower, and, further, capable of making the apparatus smaller and attaining the enhancement of the throughput of the recording apparatus without lowering the quality of recorded images, and to provide a method for controlling the scanning speed of such recording apparatus.

In order to achieve the object of the present invention, a recording apparatus provided with recording means for printing on a recording material in accordance with printing data; scanning means for causing the recording means to correlatively scan with respect to the recording material; and head driving means for printing on the recording material by driving the recording means while the correlative scan is performed by the scanning means, comprises scanning speed setting means capable of changing the scanning speeds of the scanning means; determining means for determining the recording areas on the recording material in accordance with the printing data; and controlling means for controlling the scanning speeds of the scanning means set by the scanning speed setting means.

Also, the recording apparatus of the present invention is to record by driving the recording means in accordance with the scanning speed set by the scanning speed setting means.

Also, the determining means determines the recording and non-recording areas within the recording range of the recording material in accordance with printing data for one current scan.

Also, it is possible for the determining means to prepare a table for scanning speeds of the scanning means in one current scan in accordance with the results of determination made by the determining means. In this case, the determining means is to control the scanning speeds of the scanning means in accordance with such table thus prepared.

Also, the controlling means is arranged to control the scanning speeds of the scanning means in the recording area in accordance with the distance between the position to start scanning to the position to start recording in the scanning area of the scanning means.

Also, the determining means is to determine whether or not any non-recording areas are included in the recording area of the scanning means in accordance with printing data, and change the scanning speeds of the scanning means in the non-recording areas. With such a determining means as this, it is possible to achieve the object of the present invention.

Also, a method for controlling the scanning speeds in accordance with the present invention for a recording apparatus provided with recording means for printing on a recording material in accordance with printing data; scanning means for causing the recording means to correlatively scan with respect to the recording material; and head driving means for printing on the recording material by driving the recording means while the correlative scan is performed by the scanning means, comprises the steps of determining the recording area on the recording material in accordance with printing data; setting the scanning speeds of the scanning means in accordance with the results of determination made in the determining step; and recording by driving the recording means in accordance with the scanning speeds set in the setting step. With such arrangement, it is intended to achieve the above-mentioned object efficiently.

DETAILED DESCRIPTION OF THE PREFERRED EMBODIMENTS

Figure 1:
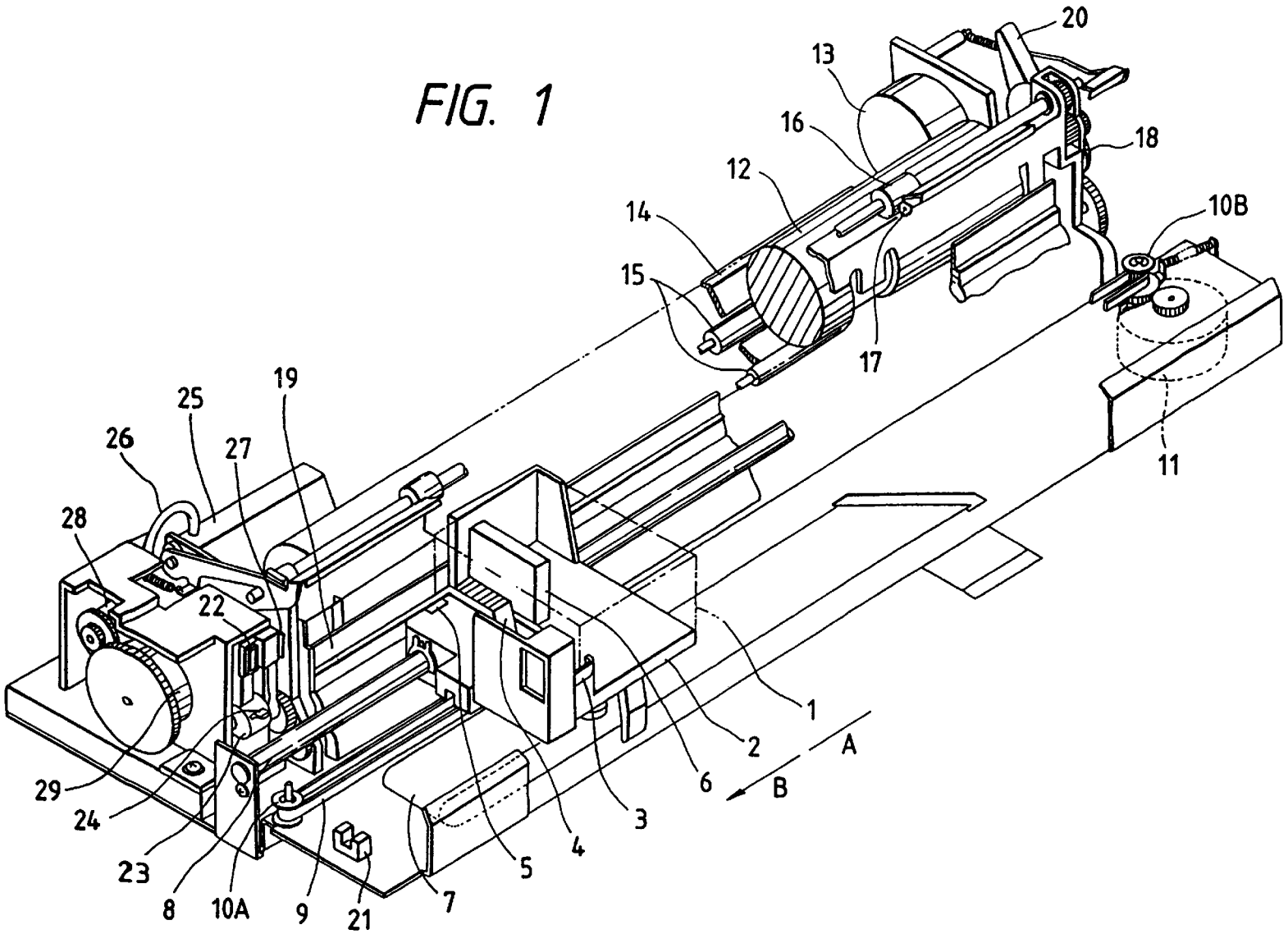
FIG. 1 is a perspective view which schematically shows the structure of one embodiment of a recording apparatus to which the present invention is applicable.

Hereinafter, with reference to the accompanying drawings, the description will be made of the embodiments in accordance with the present invention. Through out each of the drawings, the same reference numbers and marks designate the same or corresponding elements. FIG. 1 is a perspective view which schematically shows the structure of one embodiment of a recording apparatus to which the present invention is applicable. FIG. 1 illustrates a case where the recording apparatus is an ink jet recording apparatus. In FIG. 1, a reference numeral 1 designates the recording head (recording means) of an exchangeable cartridge type in which an ink retaining unit is integrally formed, and 2, a carriage having the recording head 1 installed on it, being arranged to reciprocate in the directions indicated by arrows A and B. The recording head 1 is electrically connected to the control circuit of the apparatus main body through the flexible cable 7 which will be described later.

A reference numeral 3 designates a hook for installing the recording head 1 to the carriage 2, and 4, a lever to operate the hook 3. On the carriage 2, a recess 5 is formed, and the extrusion 24, which will be described later, is inserted into the recess. A reference numeral 6 designates a supporting board to support the unit of the electrical connection with respect to the recording head 1; 7, a flexible cable to connect the control unit of the apparatus main body and the unit of the electrical connection; 8, a guide rail inserted through the bearing of the carriage 2 to guide and support the carriage 2 in the directions indicated by arrows A and B; 9, a timing belt connected to the carriage 2 for the transmission of driving force to cause the carriage 2 to travel in the directions indicated by arrows A and B. The timing belt 9 is tensioned around pulleys 10A and 10B arranged on both sides of the apparatus, respectively. To one of the pulleys 10B, the driving force is transmitted from a carriage motor 11 through a transmission mechanism formed by gears and others.

In FIG. 1, a reference numeral 12 designates a carrier roller; 13, a carrier motor to drive the carrier roller 13: the carrier roller 12 regulates the recording surface of a recording material (recording medium) such as sheet paper, and at the same time, carries (sheet feeds) the recording material in a recording operation or the like; 14, a paper pan to guide the recording material to the recording position; 15, a feed roller to press the recording material to the carrier roller 12. The feed roller 15 is arranged on the way in the feeding path of the recording material to provide a force to carry the recording material by pressing it to the carrier roller 12.

A reference numeral 16 designates a sheet exhaust roller for exhausting the recording material to an exhaust outlet (not shown), and 17, a spur arranged to face the sheet exhaust roller 16. The sheet exhaust roller 16 is arranged on the downstream side of the recording position in the carrying direction of the recording material. Also, the spur 17 is to transfer the carrying force of the sheet exhaust roller 16 to the recording material by pressing the recording material to the sheet exhaust roller 16. A reference numeral 18 designates a platen arranged in a position to face the ink discharge ports of the recording head 1. The platen 18 is biased to the front portion of the paper pan 19 by means of an elastic member (not shown) so as to arrange the platen to press and hold the recording material between them.

The recording apparatus shown in FIG. 1 is an ink jet recording apparatus. For the recording head (recording means) 1, an ink jet recording head is adopted to record while enabling ink droplets to fly toward the recording material. Consequently, there is a need for setting the gap small between the discharge ports of the recording head 1 and the recording surface of the recording material, and, at the same time, controlling such gap between them rigidly in order to avoid any contact that may otherwise take place between the recording material and the discharge ports. The front portion 19 of the paper pan is useful for regulating the position of the recording material to appropriately control this gap between the discharge ports and the recording material.

In FIG. 1, a reference numeral 20 designates a release lever to release the biasing force provided respectively for the feed roller 15, the spur 17 and the platen 18 when installing or removing the recording material, and 21, a sensor for detecting the position of the carriage 2. The sensor 21 is used to detect the event that the carriage 2 has arrived at the home position by sensing the passage of the extrusion (not shown) arranged for the carriage 2.

A reference numeral 22 designates a cap, which faces the discharge port surface (the surface where the ink discharge ports are formed) of the recording head 1, when the carriage 2 is in the home position. The cap 22 is formed by a rubbery elastic material, and supported to abut upon and retract from the discharge port surface of the recording head 1. The cap is used for protecting the discharge ports of the recording head 1 when recording is at rest, and also, for closing the discharge ports airtightly by being in contact with the discharge port surface when executing discharge recovery. The discharge recovery is to allow the cap 22 to be in contact with the discharge port surface for discharging ink from all the discharge ports (predischarge) by driving the energy generating elements arranged in the interior of discharge ports, which are utilized for discharging ink, or to forcibly exhaust ink by causing the sucking force of a pump to act upon the discharge ports while the discharge port surface is covered by the cap 22; hence removing the causes of defective discharges, such as air bubbles, dust particles, and the overly viscous ink that is no longer applicable to recording.

In FIG. 1, a reference numeral 23 designates a pump used for executing the discharge recovery. The pump 23 actuates the sucking force to be used for the execution of the forcible discharge of ink. At the same time, it is used for sucking ink received by the cap 22 when executing the discharge recovery or the discharge recovery by the application of the predischarge. On the exterior of the pump 23, an extrusion 24 is formed, which is inserted into a recess 5 formed on the carriage 2. Here, a reference numeral 25 designates a waste ink tank to retain the waste ink sucked by means of the pump 23, and 26, a tube that conductively connects the pump 23 and the waste ink tank 25.

A reference numeral 27 designates a wiping blade for wiping (to wipe off) the discharge port surface of the recording head 1 to remove ink and other substances adhering thereto. The wiping blade 27 is formed by an elastic material such as rubber, and is movably supported in the advanced position for wiping (cleaning by wiping) the discharge port surface by utilizing the movement of the carriage 2 when extruded to the recording head 1 side, and in the retracted position where it does not abut upon the discharge port surface of the recording means 1. Here, a reference numeral 28 designates a motor for the recovery system, and 29, a cam mechanism for receiving the power from the motor 28 for the recovery system in order to drive the pump 23 and cause the cap 22 and wiping blade 27 to move.

The recording head 1 is ink jet recording means for discharging ink by utilizing thermal energy, which is provided with electrothermal transducing elements for generating the thermal energy. Also, the recording head 1 is to record by discharging ink from the discharge ports by utilizing the change of pressures exerted by the development and contraction of air bubbles created by film boiling when the thermal energy is applied by means of electrothermal transducing elements.

Figure 2:
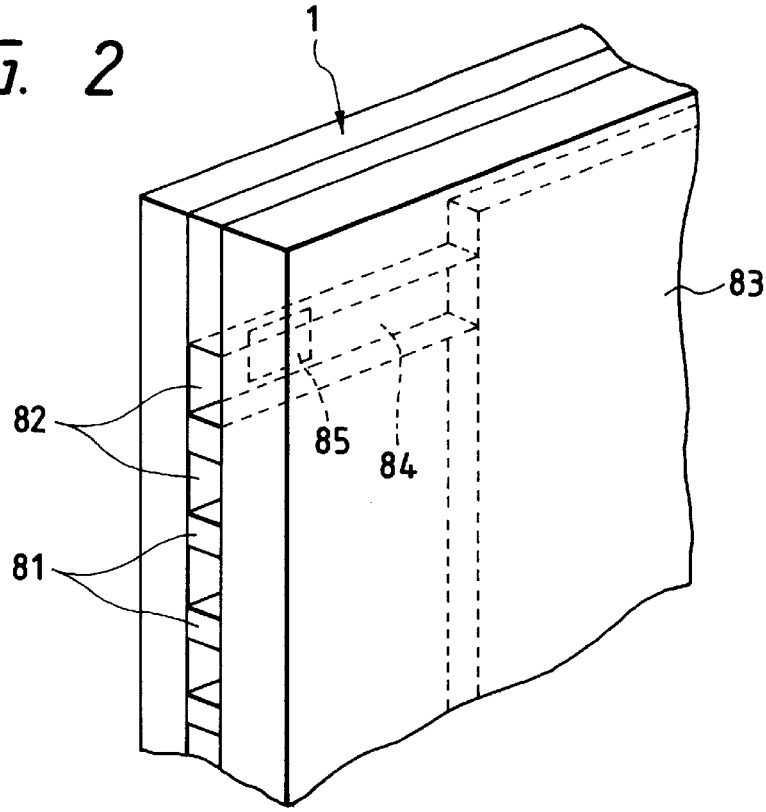
FIG. 2 is a partially perspective view which schematically shows the structure of an ink discharge unit of recording means represented in FIG. 1.

FIG. 2 is a partially perspective view which schematically shows the structure of the ink discharge unit of the recording head 1. In FIG. 2, a plurality of discharge ports 82 are formed at given pitches on the discharge port surface 81 facing a recording material (such as a recording sheet) with a given gap between them (for example, approximately 0.5 to 2.0 mm). Also, there are arranged electrothermal transducing elements (heat generating resistive elements or the like) 85 for generating energy to discharge ink along the wall faces of each liquid path 84, which conductively connects each discharge port 82 and a common liquid chamber 83 to supply ink to each of the discharge ports. In accordance with the present embodiment, the recording head 1 is installed on the carriage 2 with such a positional relationship that the discharge ports 82 are aligned in the direction intersecting the scanning direction of the carriage 2. In this way, the recording means 1 is structured to drive (energize) the corresponding electrothermal transducing elements 85 in accordance with image signals or discharge signals, hence causing ink in the respective liquid paths 84 to create the film boiling and discharge ink from the discharge ports 82 by the application of pressure thus generated at that time.

In the recording apparatus represented in FIG. 1, images are recorded by discharging ink from the respective discharge ports of the recording head in accordance with recording information, while the recording head 1 on the carriage is caused to travel (main scan) along the recording material by means of the carriage motor 11 after the recording material is set at a given recording position. After a one-line portion is recorded, the carrier roller 12 is caused to rotate for a given amount by means of the carrier motor 13 to sheet feed (carry by pitches) the recording material in order to set it on the recording position for the next line. Then, images on the next line are recorded. By repeating such operation as described above, the entire recording is executed on the recording material.

First Embodiment

Figure 3A:
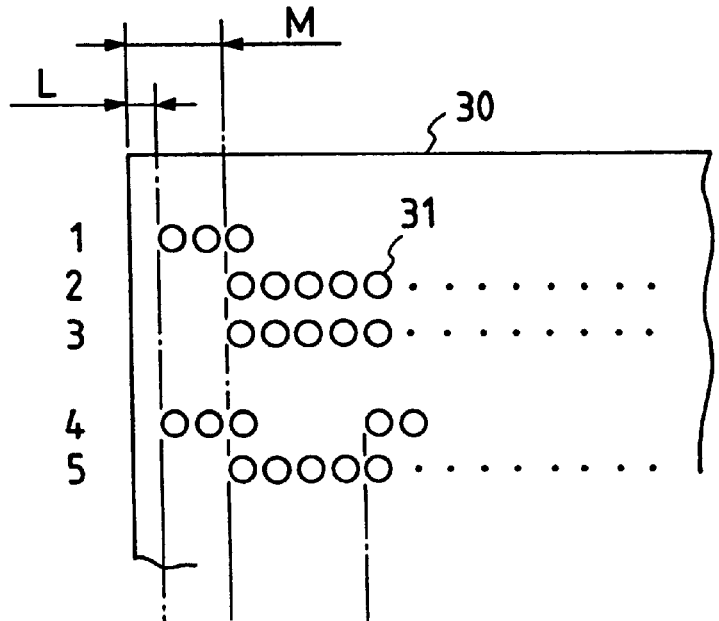
FIGS. 3A–3C are schematic views which show the recording control in accordance with a first embodiment for a recording apparatus to which the present invention is applicable.

FIG. 3A is a view which schematically shows a first embodiment of the recording control of a recording apparatus to which the present invention is applicable. In FIG. 3A, a control in one directional recording of the present invention is illustrated with respect to a document to be recorded, where the left recording blank is set at L=5 mm for a recording material 30. In FIG. 3A, a reference numeral 31 designates each of the characters to be recorded. Also, in the present embodiment, the carriage motor 11 is a stepping motor whose diameter is 42 mm. Its one-step angle is 7.5 degrees. The stepping motor 11 is able to keep the carriage 2 having the recording head 1 installed on it in a stabilized driving condition (that is, a state where the velocity variation is minute) through a 72-step uniform acceleration in terms of pulse rates of 600 pps to 1,440 pps, and a 78-step constant velocity area. Further, as regards the velocity of less than 1,440 pps, it is accelerated to the required speed V in accordance with a table of accelerations prepared up to 1,440 pps, and in the constant velocity area, it performs to provide a stabilized condition of $[(V-600)/(1{,}440-600)]\times 78$ steps.

Figure 3B:
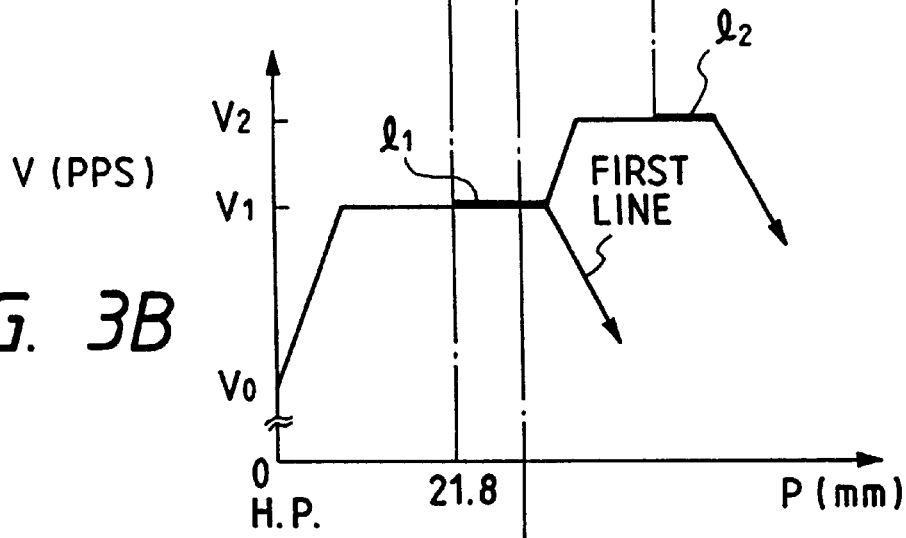
Figure 3C:
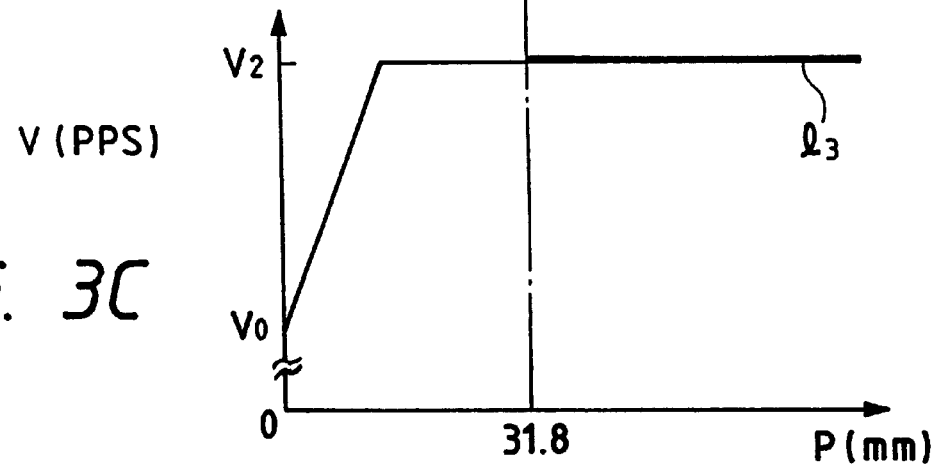

In FIG. 3A, the figures on the left side of the recording material 30 indicate the number of lines to be recorded. On the graphs shown in FIGS. 3B–C which illustrate the relationship between the carriage speeds V and the carriage positions P, each area indicated by thick line represents the area where a recording operation is executed.

The recording on the first line shows that the gap is small between the left end side of the recording material 30 and the position to start recording. Thus, as shown in the middle part of FIG. 3B, acceleration is given until the carriage speed becomes as indicated at $V_1$. Then, after recording is completed in the area indicated as at $l_1$, the carriage is decelerated. In continuation, the returning operation is performed to return the carriage to its home position side.

Also, for recordings on the second, third, and fifth lines, each of the gaps is large between the left end side of the recording material 30 and the position to start recording to make it possible to accelerate the carriage sufficiently. Therefore, as shown in the lower part of FIG. 3C, the carriage is accelerated up to $V_2$, which is faster than $V_1$. Then, each recording is completed as indicated at $l_3$.

For the recording on the fourth line, the carriage is accelerated to the speed $V_1$ as in the case of the recording on the first line, and then, the recording is performed in the area $l_1$. For the fourth line recording, there is a non-recording area. Therefore, as shown in the graph illustrated in the middle part of FIG. 3B, the carriage speed is accelerated from $V_1$ to $V_2$ in the non-recording area, and then, the recording is executed in the area $l_2$.

Now, the description will be made of the recording operation on each line, centering on the control of the carriage motor.

In FIG. 3A, the left recording blank is set at 5 mm for the first line. The uniform acceleration is given from the speed $V_0$ (600 pps) to the speed $V_1$ (1,175 pps) at 49 steps from the stop position of carriage 2 (home position) to the position to start recording. After the constant traveling at 53 steps, a three-letter portion is recorded in the stabilized driving condition. Also, in the fourth line, the left recording blank is set at 5 mm, and the uniform acceleration is given up to the speed $V_1$ at 49 steps from the stop position of the carriage 2 (home position) to the position to start recording as in the first line, and then, the carriage is in the stabilized driving condition at 53 steps to record a three-letter portion. In the subsequent space (non-recording area) of 10 mm, the uniform acceleration is given up to the speed $V_2$ (1,440 pps) at 23 steps. After a constant traveling at 25 steps, the contents to follow are recorded in the stabilized driving condition.

Figure 4:
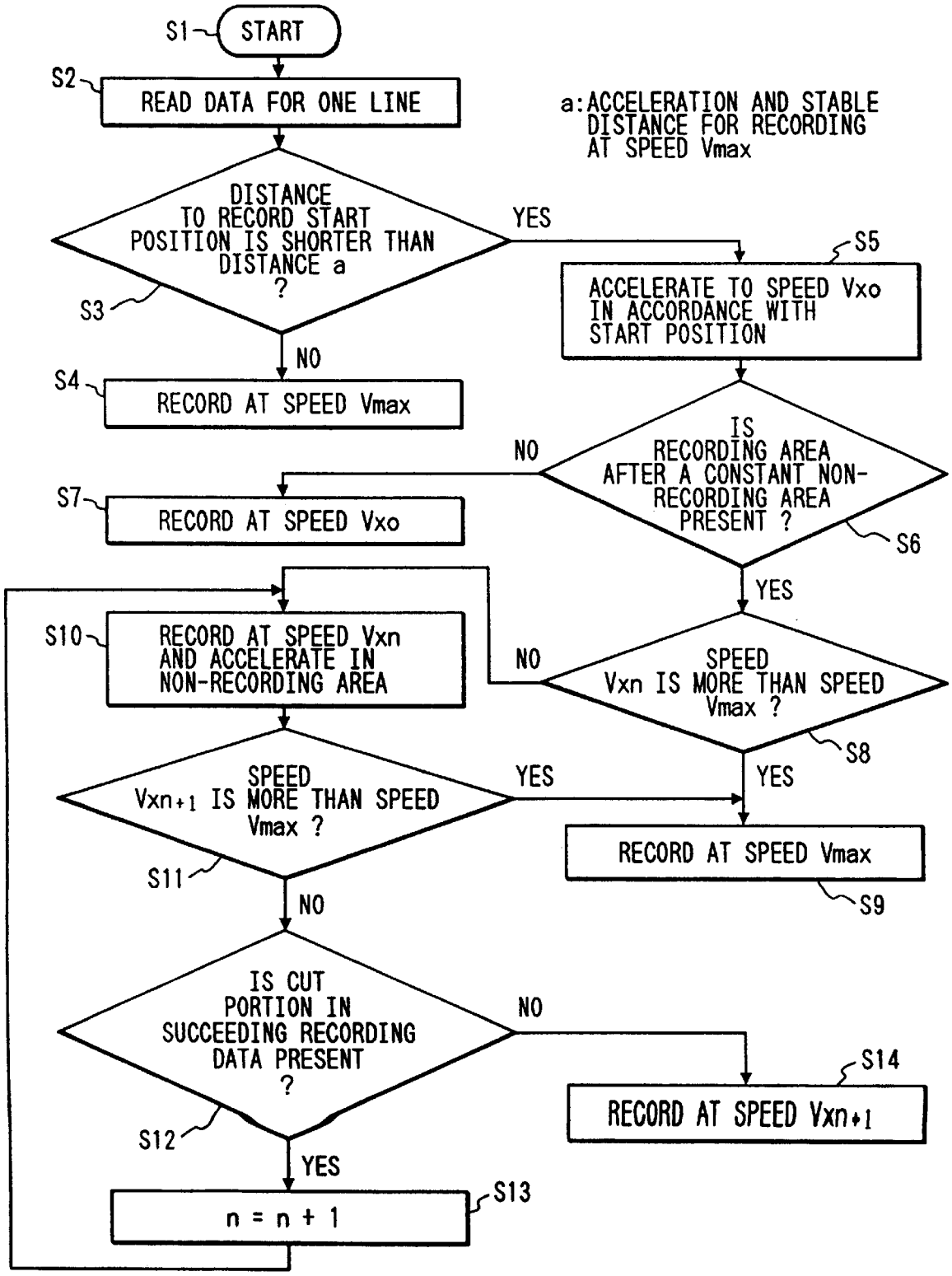
FIG. 4 is a flowchart which illustrates the operational sequence of the recording control represented in FIG. 3.
Figure 5:
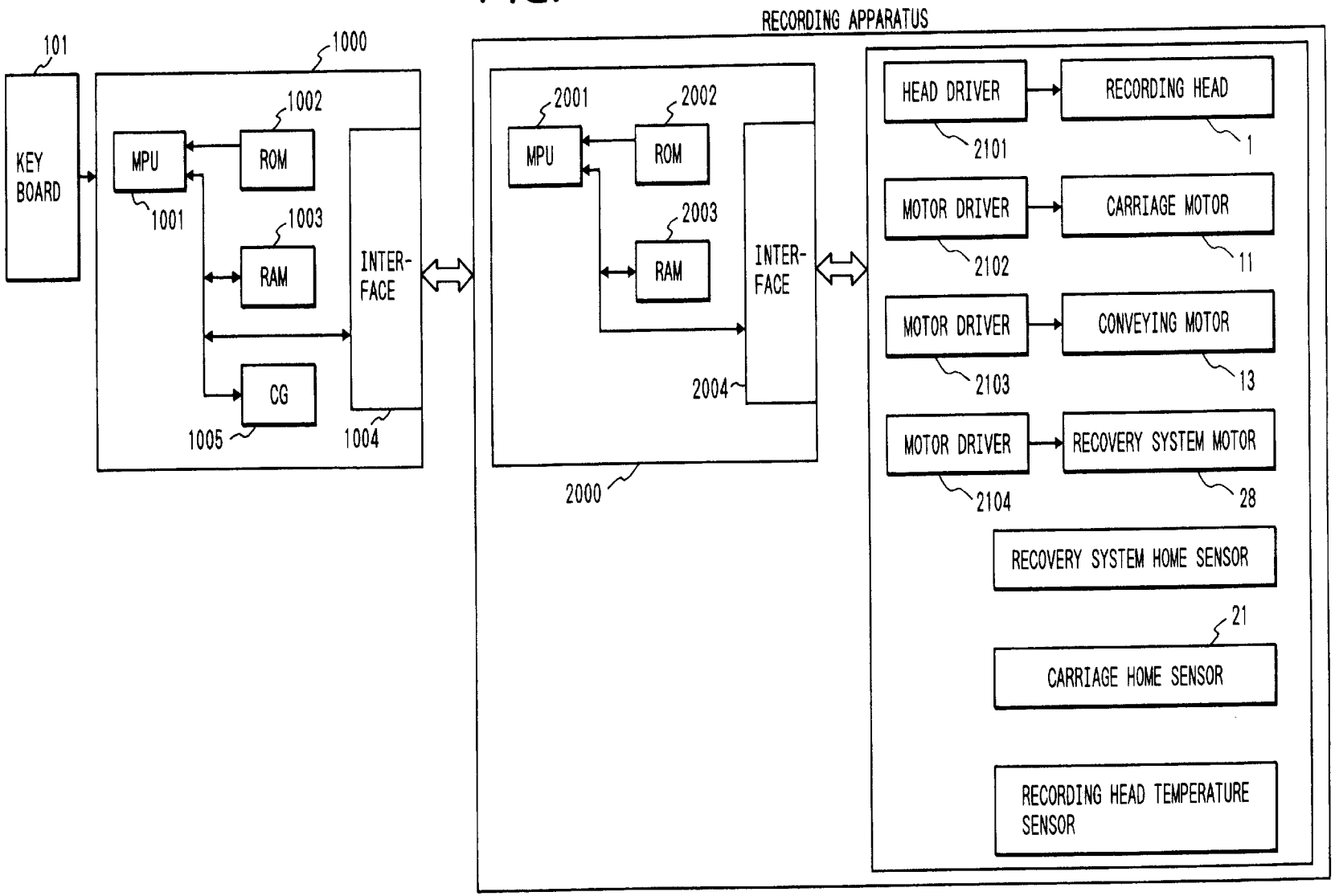
FIG. 5 is a block diagram which shows the structure of a control system preferably applicable to executing the control represented in FIG. 3.

In FIG. 3A, the left recording blank is set at M=15 mm for the second and third lines, respectively. The constant acceleration is given up to the speed $V_2$ at 72 steps from the stop position of the carriage 2 to the position to start recording. Then, after a constant traveling at 78 steps, the recording is performed in the stabilized driving condition. FIG. 4 illustrates one example of flowchart showing the recording control (the first embodiment) represented in FIGS. 3A–C. FIG. 5 is a block diagram showing the structure of the control unit of a recording apparatus.

In FIG. 5, a reference numeral 1000 designates a controlling apparatus such as a host computer to supply data, which is connected to a recording apparatus; 101, a key board to operate the controlling apparatus 1000; 2000, a control unit of the recording apparatus installed on the recording apparatus side. The controlling apparatus 1000 comprises a ROM 1002, a RAM 1003 as memory means, an interface unit 1004 for executing input from and output to external equipment connected thereto, a character generator 1005, and a MPU 1001 for performing various control operations, and others. Also, for the control unit of the recording apparatus, there are provided a MPU 2001 for performing various control operations, a ROM 2002, and a RAM 2003 to control various drivers, sensors, and others through the interface unit 2004.

Now, in conjunction with the flowchart shown in FIG. 4, the description will be made of the recording operation in accordance with the present invention.

At first, in step S1, recording is started, and then, in step S2 to follow, data on a one-line portion are read. Here, the data on the one-line portion are data for the one scan portion to be performed by the recording head 1, depending on the recording width (dot numbers) of the recording head, and the width of the recording area that the carriage scans for recording. Subsequently in step S3, the distance between the position to start scanning by the recording head and the position to start recording is compared with $\alpha$. Here, the $\alpha$ means a distance needed for the carriage to obtain a sufficient acceleration and perform its scanning at a stable speed, provided that the scanning speed of the carriage is $V_{max}$ for recording.

In the step S3, if it is determined that the distance to the position to start recording is greater than $\alpha$, the process will proceed to step S4 where the recording is executed at the carriage speed at $V_{max}$. Also, in the step S3, if the distance to the position to start recording is less than $\alpha$, the process will proceed to step S5 where acceleration is given up to a speed $V_{x0}$ that corresponds to the distance to the position to start recording. It is desirable that the $V_{x0}$ is a speed to provide a sufficient acceleration by the distance to the position to start recording, and at the same time, to enable the recording to be performed stably beginning at the position to start recording. In the next step S6, it is determined whether or not there is any non-recording area that may be larger than a specific area, and also, any recording area that may follow such non-recording area simultaneously. If negative in the step S6, the process will proceed to step S7 where the recording is performed by causing the carriage to scan at the speed $V_{x0}$ set in the step S5 for the execution of the current recording scan. In the step S8 to follow, the scanning speed currently set is compared with the $V_{max}$. If the currently set scanning speed is higher than the $V_{max}$, the speed is set at the $V_{max}$ in the step S9 so as to control the scanning speed of the carriage not to exceed the $V_{max}$. If the currently set scanning speed is lower than the $V_{max}$ in the step S8, the process will proceed to step S10 where the recording is performed until arriving at the non-recording area while causing the carriage to scan at a scanning speed $V_{xn}$ (in the present stage, the speed being $V_{x0}$ set in the step S5). Then, in continuation, the scanning speed of the carriage is accelerated in the non-recording area (the scanning speed at that time being $V_{xn+1}$). In the step S11 to follow, the $V_{xn+1}$ and $V_{max}$ are compared. If $V_{xn+1}>V_{max}$ the process will proceed to step S9 where the scanning speed of the carriage is made $V_{max}$ in order to control it not to exceed the $V_{max}$. If it is determined that $V_{max}>V_{xn+1}$ in the step S11 the process will proceed to step S12 where it is determined whether or not there is any non-recording area and recording area to follow such non-recording area in the remaining area. If negative in the step S12, the process will proceed to step S14 where the carriage is caused to scan for recording at the speed $V_{xn+1}$ set in the previous step. If affirmative in the step S12, that is, there is a portion interrupted by the non-recording area, the process will proceed to step S13 where "1" is added to "n", and then, proceed to the step S10. In this way, by executing the operations in the steps S10 to S14, the scanning speed of the carriage is accelerated within the range that does not exceed the $V_{max}$ each time any interrupted portion is encountered due to the non-recording area. In this way, it is possible to attain a higher speed recording, while obtaining a high-quality images at a stable scanning speed.

As described above, the left recording blank is set at 15 mm to make the acceleration up to the speed $V_1$ possible by the application of one-stage acceleration.

Then, by deciding on the home position on this basis, and arranging the structure at the same time so that the control represented in FIG. 3 is made executable by the control unit shown in FIG. 5 in accordance with the flowchart shown in FIG. 4, it is possible to shift the home position of the carriage 2 to the inside by 10 mm without inviting any significant reduction of the recording speed as compared with the conventional example. Therefore, the resultant width of the recording apparatus is made narrower by 10 mm. In this respect, the control represented in FIG. 3 may be arranged to be executable by use of a wordprocessor or a personal computer in place of the control unit of the recording apparatus shown in FIG. 5.

Also, while the control described in conjunction with FIG. 3 to FIG. 5 is applied only to a recording material 30 having a specific recordable width for a recording apparatus, it is possible to apply the conventional control as it is by shifting the setting position to the inner side of a recording material of other sizes that allow the setting position to shift within the sheet setting width. For a document whose left recording blank is 5 mm for the most part thereof, it is conceivable that the total recording time may be slightly affected in some cases if the control described above is applied as it is. However, for a recording material of a specific width, it is possible to reliably prevent the total recording time from being affected even in such a case as above.

Second Embodiment

Now, with reference to the accompanying drawings, the description will be made of a second embodiment in accordance with the present invention. In the present embodiment, a control is effectuated to decelerate the scanning speed of a carriage by utilizing the non-recording area in the area being scanned for recording in order to shorten the distance between the position to terminate recording and the position to stop the carriage.

Figure 6A:
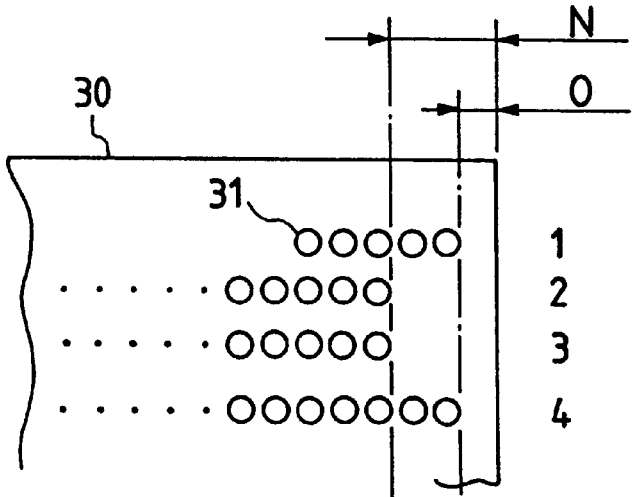
FIGS. 6A–6C schematically show the recording control in accordance with a second embodiment for a recording apparatus to which the present invention is applicable.

FIG. 6A is a schematic view which shows the recording control of a recording apparatus to which the present invention is applicable. FIG. 6A illustrates the scanning control of a carriage in the vicinity of the right end portion of a recording material (that is, near the decelerating area) for a recording apparatus structured to record by causing the carriage to travel from left to right in FIG. 6A.

A reference mark 11 designates scanning speeds V of the carriage and positions P thereof for the first line on the recording material. Also, a reference mark 12 designates recording on the fourth line; 13, those on the second line and third line. Here, the description is made by defining the position P of the carriage on the recording material 30 as x at its right-most end.

The present embodiment is such that in the same structure as the first embodiment, the control is effectuated for one directional recording of the present invention for a document whose right recording blank is set at N=5 mm at the minimum. In the present embodiment, too, the same stepping motor employed for the execution of the first embodiment is used as the carriage motor 11. This motor is suspendible by a deceleration of 72 steps from 1,440 pps to 600 pps. Also, for the deceleration from the speed V of less than 1440 pps, it is capable of being suspended by the application of decelerations by the speeds V of the deceleration table beginning at 1,440 pps.

Figure 6B:
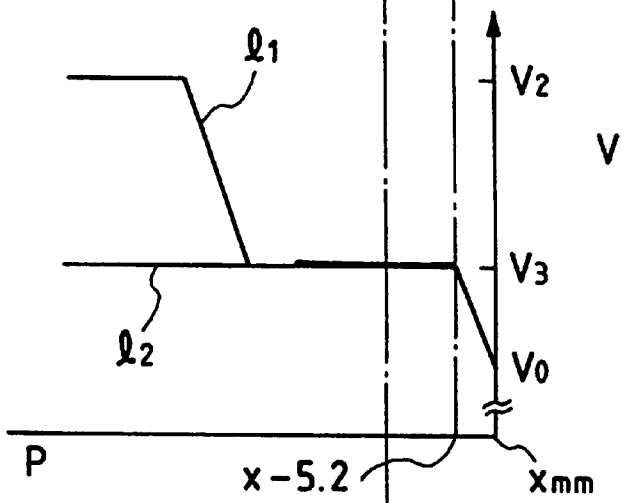
Figure 6C:
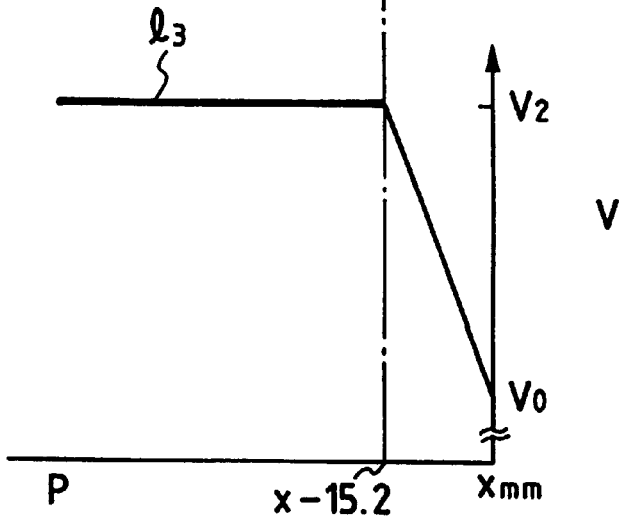

In FIGS. 6A–C the right recording blank is 5 mm for the first line, and the recording is performed at the speed of $V_3$ in the last recording section. Then, from the position to terminate recording to the position to stop the carriage 2, a deceleration of 25. steps is given before it is suspended. Also, for the second and third lines, the right recording blanks are set at O=15 mm, the suspension takes place beginning at the speed $V_3$ through 72 steps from the position to terminate recording to the position to stop the carriage. By executing the control described above in the same structure as arranged for the first embodiment, it is possible to move the stop position of the carriage 2 at the right end to the inner side by 10 mm. Thus the resultant width of the recording apparatus is made narrower by 10 mm. In this way, it is possible to shorten the width of the recording apparatus by 20 mm by the combined application of the first and second embodiments.

Also, for the recording on the fourth line designated by a reference mark 12, there is not any non-recording area for it. Also, the right recording blank is 5 mm. Consequently, it is impossible to effectuate any deceleration control in the scanning area for recording. Therefore, it is arranged to set the scanning speed V at $V_3$, which is slower than the $V_2$ for recording. In this way, it is made possible to suspend the recording after a sufficient deceleration of the carriage even if the deceleration area is made shorter.

In accordance with the present invention described by the first and second embodiments thereof, the structure is arranged so that the scanning speed of recording means is accelerated or decelerated in a recording area by utilizing the non-recording area, and that the traveling speed (main scanning speed) is set in accordance with the distance between the suspending position and the position to start recording or the distance between the position to terminate recording and the stop position, hence making it possible to narrow the traveling range of the carriage 2, and to materialize making a recording apparatus significantly smaller without expanding the left and right recording blanks, lowering the quality of recorded images, and increasing costs.

Third Embodiment

Figure 7:
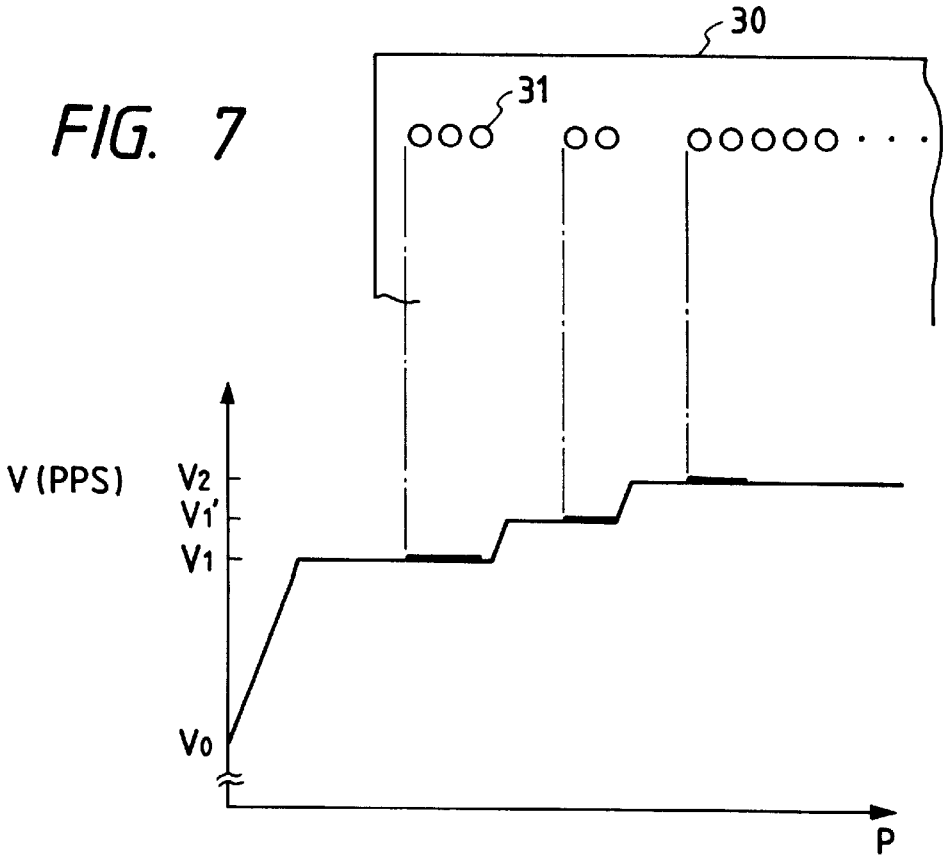
FIG. 7 is a velocity chart which illustrates the control in accordance with a third embodiment where a carriage is accelerated and decelerated in a multiple stage for each of embodiments represented in FIGS. 3A–C and FIGS. 6A–6C, respectively.

FIG. 7 is a velocity chart which shows an example of control in accordance with a third embodiment where a carriage is accelerated or decelerated in multiple steps. As shown in FIG. 7, it is possible to execute accelerations and decelerations in the multiple steps in the same manner in each of non-recording areas. In a case of a document having a large space or a document having wider pitches between letters, where the acceleration and deceleration are executable between letters, it is possible to effectuate the control in a multiple step finer than the first and second embodiments by executing the control as in the third embodiment illustrated in FIG. 7. By the application of such control in the multiple steps, it is possible to obtain the effect that the period required for throughput of a recording apparatus is made shorter still by the further reduction of the traveling time of the carriage.

Fourth Embodiment

Figure 8:
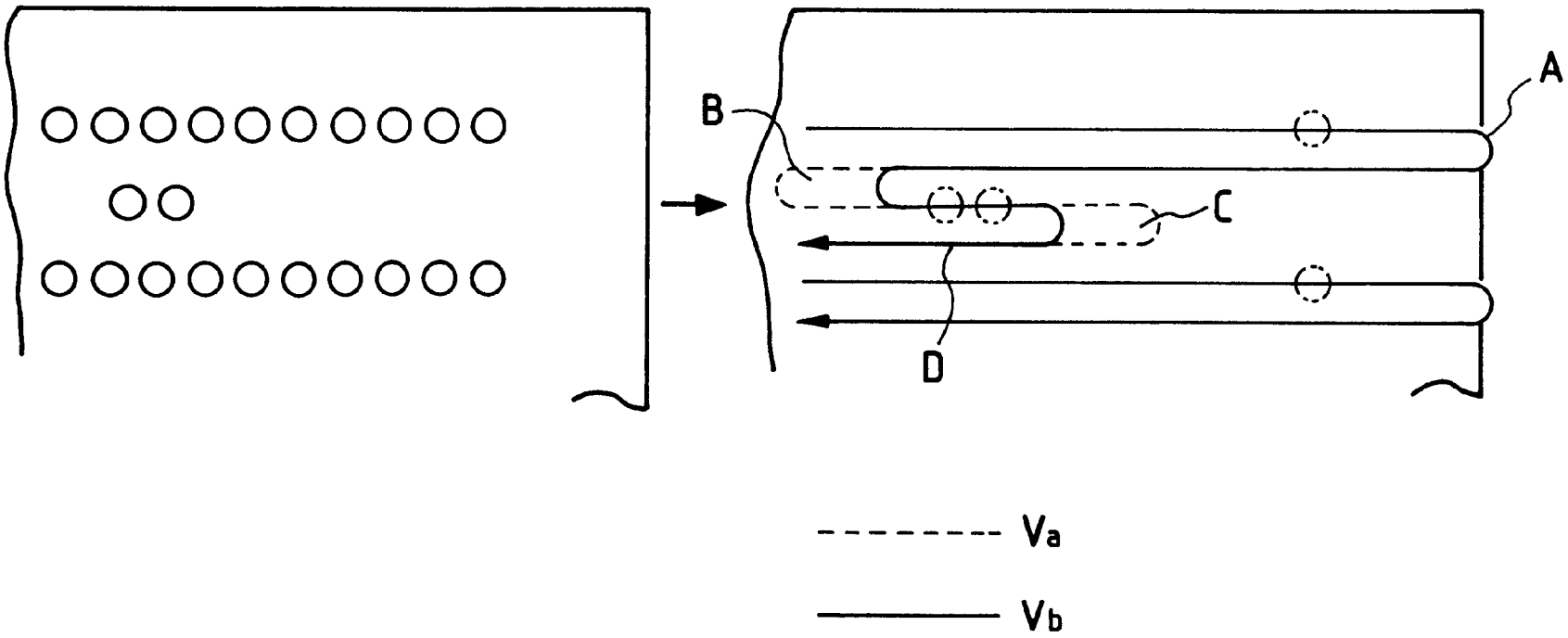
FIG. 8 is a schematic view which shows the recording control in accordance with a fourth embodiment for a recording apparatus to which the present invention is applicable in accordance with a fourth embodiment.
Figure 9:
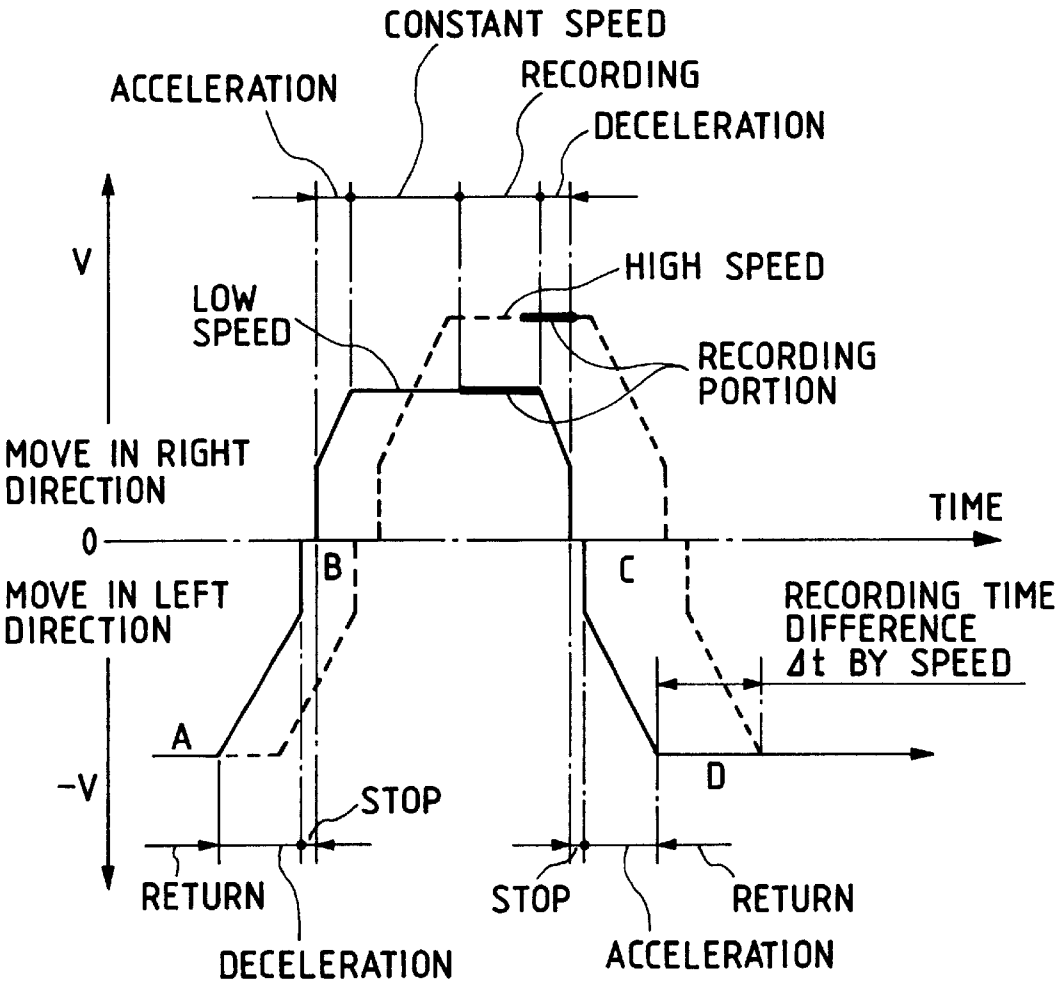
FIG. 9 is a velocity chart which shows the traveling control of the carriage in regard to the recording control represented in FIG. 8.
Figure 10:
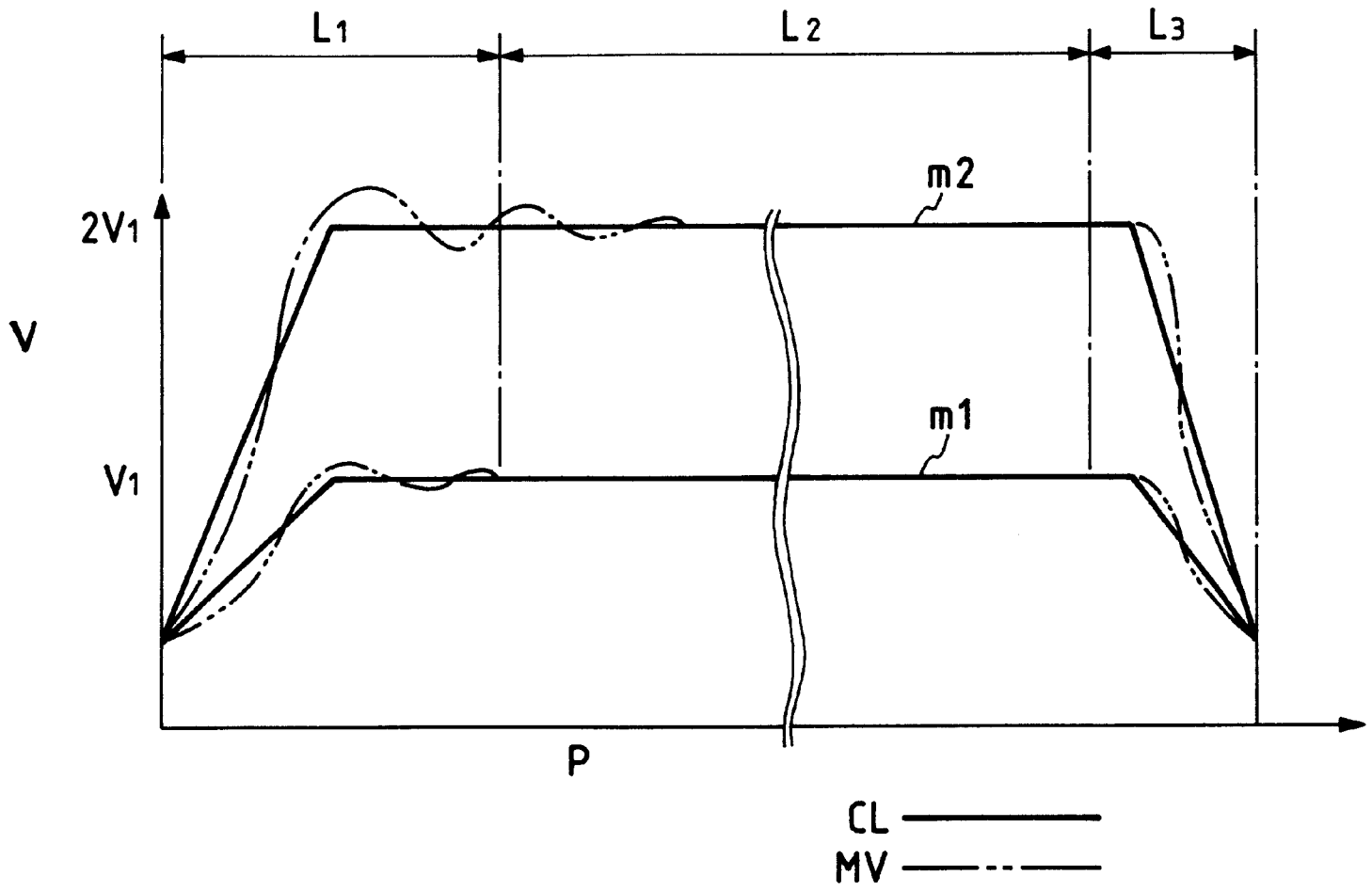
FIG. 10 is a velocity chart which shows the example the acceleration and deceleration control of a carriage motor generally used, as well as the movement of the carriage.
Figure 11:
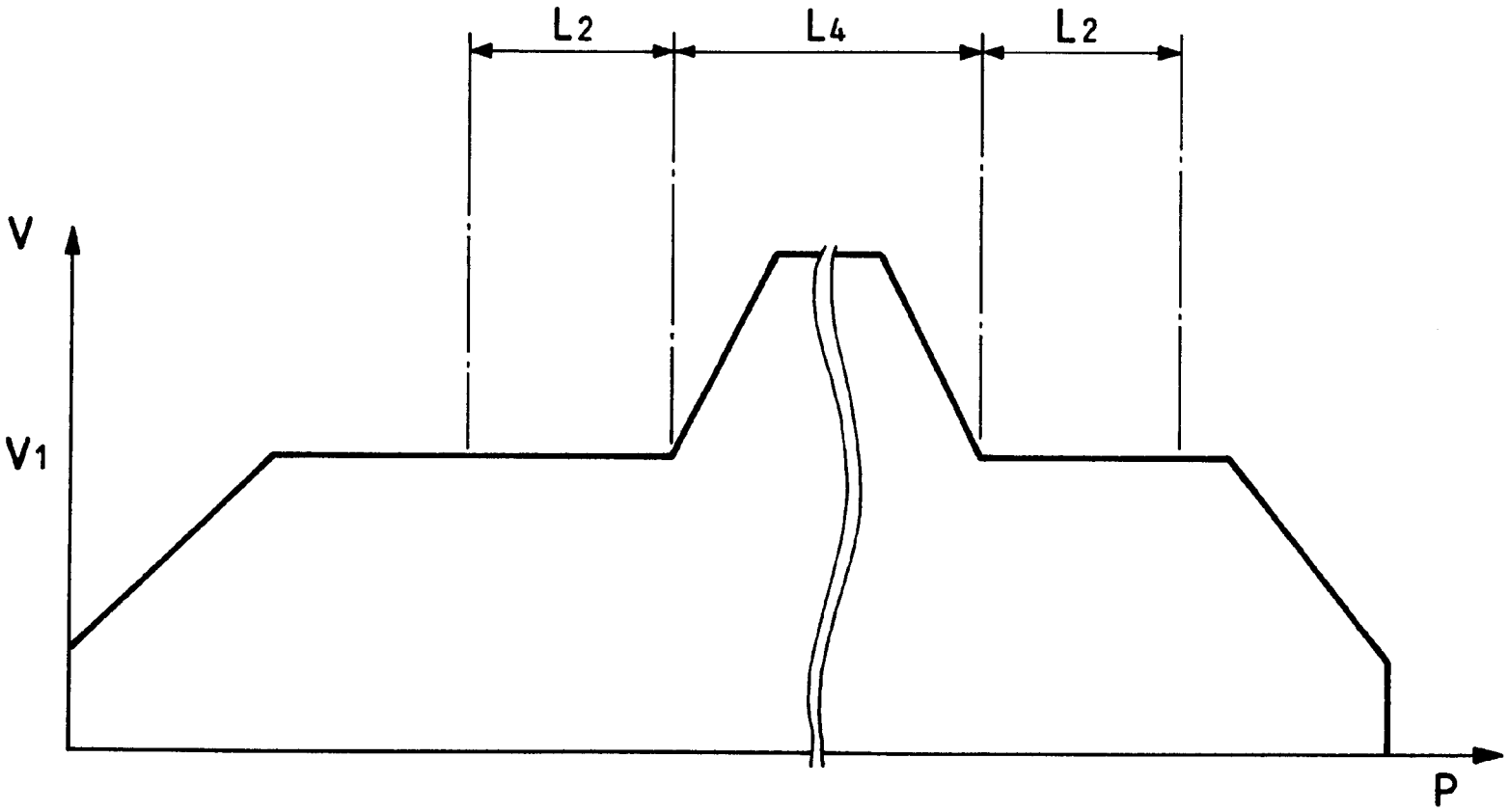
FIG. 11 is a velocity chart which shows one example of recording control by the application of the conventional art.
Figure 12:
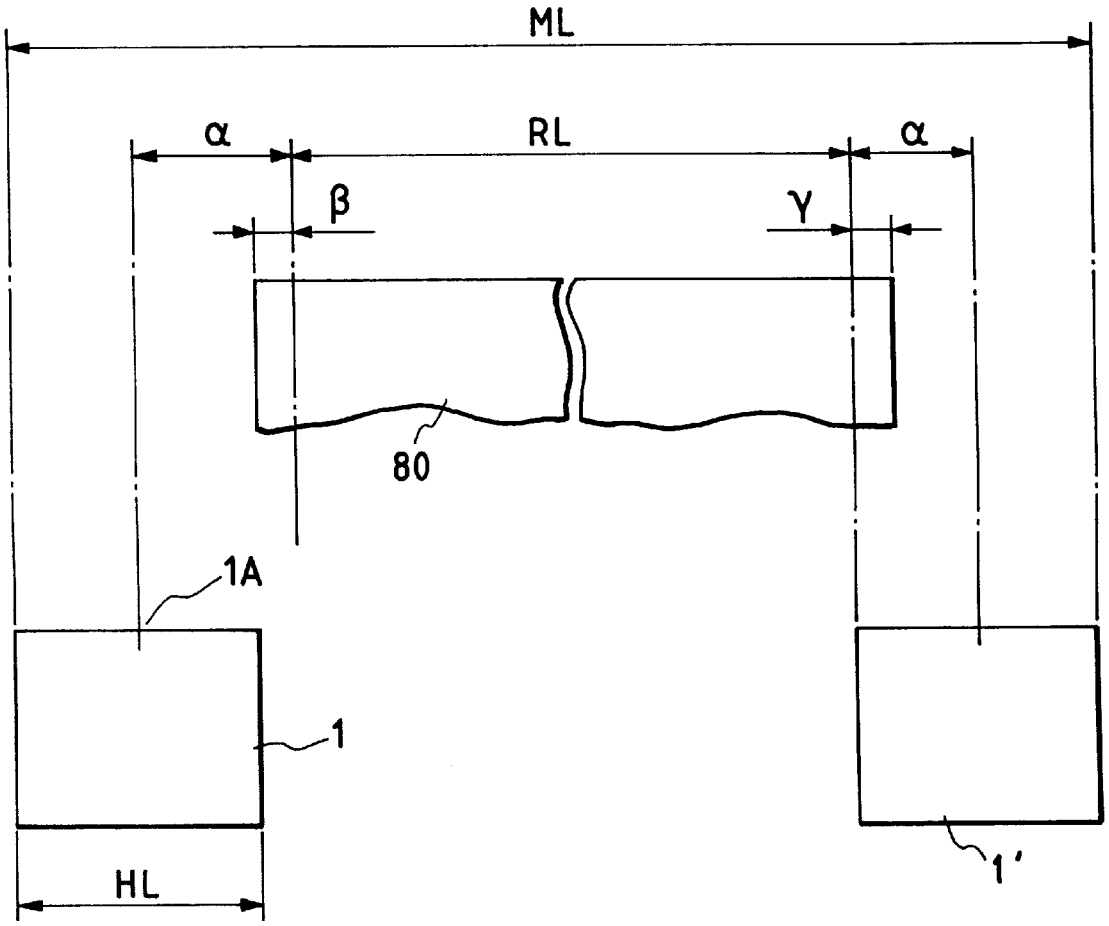
FIG. 12 is a view which schematically shows the factors for determining the width of a recording apparatus.

FIG. 8 is a schematic view which shows a fourth embodiment of the recording control of a recording apparatus to which the present invention is applicable. FIG. 9 is a velocity chart which shows the control of the traveling speed of a carriage by means of the recording control as illustrated in FIG. 8. In the present embodiment illustrated in FIG. 8 and FIG. 9, a control is effectuated by the one directional recording of the present invention in a case where the occupying ratio of the acceleration and deceleration areas is greater against the recording areas because of the contents to be recorded.

In FIG. 8, a reference mark $V_a$ indicated by dotted line shows the movement of a carriage when the carriage is caused to travel at a high speed; also, $V_b$ indicated by solid line shows the movement of the carriage when it is caused to scan at a low speed.

Usually, the total recording time shows its minimum when recording is performed at the highest main scanning speed. However, as shown in FIG. 8 and FIG. 9, if the recording area is narrower, the total recording time does not necessarily show the minimum even when the recording is performed at the highest main scanning speed, because there is a need for the wider area of acceleration and deceleration to carry out the highest main scanning.

Therefore, in the present embodiment, it is arranged to determine the contents of recording on the second line and on the lines before and after that, and then, after recording on the first line at the highest main scanning speed, an optimal recording speed V is calculated for the recording on the second line in order to make the total recording time the minimum by taking into account the relationship between the acceleration and deceleration areas and the recording area, thus making it possible to record at a speed V ($V_1$ in the first embodiment, for example) that is slower than the highest speed. In this case, the recording speed is slower, but the time conventionally required for the acceleration and deceleration is shortened. Subsequently, the recording on the third line is performed at the highest main scanning speed as in the recording on the first line. In this way, the total recording time is made shorter. In this respect, it is possible to use the control illustrated in FIG. 8 and FIG. 9 in combination with those shown in the first to third embodiments.

In accordance with the fourth embodiment shown in FIG. 8 and FIG. 9, the traveling speed of the recording head 1 in the recording area is accelerated and decelerated by utilizing the non-recording areas as in the first to third embodiments. Then the traveling speed is set in accordance with the distance between the stop position to the position to start recording or the distance between the position to terminate recording and the stop position so that the traveling range of the carriage 2 is made narrower. Thus it is possible to obtain the effect that a recording apparatus is made significantly smaller without expanding the left and right recording blanks, lowering the quality of recorded images, and increasing costs. In addition, by setting the main scanning speed in accordance with the contents in the recording area, it is possible to obtain the effect that the total recording time (throughput) required for the acceleration and deceleration areas and the recording area is shortened.

Fifth Embodiment

In accordance with the fourth embodiment, the traveling speeds of the carriage (main scanning speed) are determined for the recording areas on a certain line by taking into account the relationship between the recording contents on such line and the line before (after) that line. However, in place of the fourth embodiment, it is possible to arrange the structure as a fifth embodiment in order to determine the recording contents over several lines. In this way, it is possible to shorten the total recording time more than the case where the fourth embodiment is applied. For example, when this embodiment is applied to a page printer, the recording contents on one page are determined in order to decide on the traveling speed of the carriage (main scanning speed) for each of the recording areas. In this way, it is possible to execute recording without any waste of time at all. The fifth embodiment described here may be applicable as required in combination with each control described in the first, second and third embodiments as in the case of the fourth embodiment.

Other Embodiments

The present invention is not necessarily limited to the embodiments described above. The embodiments are not necessarily limited only to the above descriptions, either. For example, it is possible to apply the numerical values freely in accordance with the specification and performance of a recording apparatus. Also, regarding the methods described, it is possible to equally apply the reciprocal recording as a recording method. As to the acceleration and deceleration method, it is possible to equally apply an S-letter acceleration or other acceleration and deceleration methods. For recording documents, it is possible to equally apply the method to recording by pictures, not necessarily only by letters or images. Further, it is possible to equally apply the method to all other recordings such as the one in the draft mode.

Here, in the above embodiments, the description has been made of the case where the present invention is applied to an ink jet recording apparatus as an example. However, it is equally applicable to the recording apparatuses of a wire-dot type, thermo-sensitive type, thermal transfer type or laser beam type. The present invention is capable of demonstrating the same effects.

Also, in the embodiments described above, it is exemplified to use a recording apparatus having one recording means, but the present invention is applicable to a recording apparatus using a plurality of recording means for use of recording in colors or in tonal graduation or the like, or applicable to a recording apparatus provided with plural kinds of dot formation means for one recording head or the like. The present invention is applicable to the recording apparatuses irrespective of the modes of recording means, and the same effects are obtainable.

Further, in the case of an ink jet recording apparatus, the present invention is equally applicable irrespective of the structural arrangements of the recording head and ink tank, such as using an exchangeable head cartridge in which a recording head and an ink tank are integrated, or using a recording head and an ink tank separately with the provision of ink supply tube or the like to connect them. Then it is possible to obtain the same effects.

Also, when an ink jet recording apparatus is adopted, the present invention is applicable to recording means (recording head) using electro-mechanical transducing elements or the like, such as those using piezoelectric elements. Of such apparatuses, however, the present invention demonstrates particularly excellent effects when it is applied to an ink jet recording apparatus provided with recording means using a method in which ink is discharged by utilizing thermal energy. With such method, it is possible to attain a highly densified recording in a higher precision.

As clear from the above descriptions, it is possible to narrow the scanning range of a carriage in accordance with the present invention, hence providing a recording apparatus that is capable of making its main body smaller without lowering the quality of recorded images. Further, in accordance with the present invention, it is possible to shorten the traveling time required for a carriage in the acceleration and deceleration areas by setting the traveling speeds in each of the recording areas in accordance with the contents to be recorded, thus enhancing the throughput of a recording apparatus.

What is claimed is:

1. A recording apparatus provided with recording means for printing on a recording material in accordance with received printing data; scanning means for causing the recording means to correlatively scan with respect to the recording material; and head driving means for driving the recording means for printing on the recording material during the correlative scan of the recording means by the scanning means, comprising:

scanning speed setting means for setting and changing scanning speeds of the scanning means;

determining means for determining recording areas on the recording material in accordance with the printing data, said determining means determining amounts of recording area and non-recording area in an area for scanning the recording means; and controlling means for controlling said scanning speed setting means to control the scanning speeds of the scanning means in accordance with the printing data, and determining a changed speed based on an amount of the non-recording area and controlling such that scanning speeds of said scanning means are changed to the determined changed speed in the non-recording area determined by said determining means, wherein said control means determines a speed for scanning the recording means in accordance with an area where the recording means is moved by a previous scanning and the amount of recording area in the area for scanning the recording means.

2. A recording apparatus according to claim 1, further comprising:

driving control means for driving the recording means to record an image in accordance with the scanning speeds set by said scanning speed setting means.

3. A recording apparatus according to claim 1, wherein said determining means determines recording areas and non-recording areas within a recording range of the recording material in accordance with printing data during one scan.

4. A recording apparatus according to claim 1, further comprising:

means for preparing a table of scanning speeds of the scanning means during one scan in accordance with a determination by said determining means, wherein said controlling means controls the scanning speeds of the scanning means in accordance with the table.

5. A recording apparatus according to claim 1, wherein said controlling means controls the scanning speeds of the scanning means in the recording area in accordance with a distance between a position to start scanning and a position to start recording on the recording material within an area scanned by the scanning means.

6. A recording apparatus according to claim 1, wherein said determining means determines whether or not any non-recording area is included in the recording range of said recording material in accordance with said printing data, and said controlling means performs change of scanning speeds of said scanning means in said non-recording area.

7. A recording apparatus according to claim 1, wherein said controlling means controls the scanning speeds of the scanning means in accordance with recording areas and non-recording areas determined by said determining means within a recording range of the recording material.

8. A recording apparatus according to claim 7, wherein said determining means makes a determination in accordance with printing data corresponding to recording areas scanned plural times, and said controlling means controls scanning speeds in accordance with recording areas and non-recording areas scanned plural times and determined by said determining means.

9. A recording apparatus according to claim 1, wherein the recording means is provided with discharge ports to discharge ink, and discharge means for discharging ink from the discharge ports to print by discharging ink onto the recording material.

10. A recording apparatus according to claim 9, wherein the discharge means comprise electrothermal transducing elements that apply thermal energy to ink to cause a change of state of the ink to discharge the ink.

11. A method for controlling scanning speeds of a recording apparatus provided with recording means for printing on a recording material in accordance with received printing data; scanning means for causing the recording means to correlatively scan with respect to the recording material; and head driving means for driving the recording means for printing on the recording material during the correlative scan of the recording means by the scanning means, comprising the following steps of:

determining recording areas on the recording material, and determining amounts of recording area and non-recording area in an area for scanning the recording means;

setting scanning speeds of the scanning means in accordance with a determination in said determining step, the scanning speeds of the scanning means being changed in the non-recording area based on the amount of the non-recording area, wherein said setting step determines a speed for scanning the recording means in accordance with an area where the recording means is moved by a previous scanning and the amount of recording area in the area for scanning the recording means; and recording by driving the recording means in accordance with the scanning speeds set in said setting step.

12. A method for controlling scanning speeds according to claim 11, wherein said determining step determines recording areas and non-recording areas within a recording range of the recording material in accordance with printing data during one scan.

13. A method for controlling scanning speeds according to claim 11, further comprising the step of:

preparing a table of scanning speeds of the scanning means during one scan in accordance with the results of the determination in said determining step, wherein the scanning speeds of the scanning means are controlled in accordance with the table in said setting step.

14. A method for controlling scanning speeds according to claim 11, wherein the scanning speeds of the scanning means in the recording areas are set in said setting step in accordance with a distance between a position to start scanning and a position to start recording on the recording material in a recording range of the scanning means.

15. A method for controlling scanning speeds according to claim 11, wherein it is determined in said determining step whether or not any non-recording areas are included within the recording range of said recording material in accordance with said printing data, and in said setting step, the scanning speeds of said scanning means are changed in said non-recording areas.

16. A method for controlling scanning speeds according to claim 11, further including the step of providing the recording means with discharge ports to discharge ink, and providing discharge means for discharging ink from the discharge ports to print by discharging ink onto the recording material.

17. A method for controlling scanning speeds according to claim 16, wherein the discharge means comprise electrothermal transducing elements that apply thermal energy to ink to cause a change of state of the ink to discharge the ink.

18. A recording apparatus provided with recording means for printing on a recording material in accordance with received printing data; scanning means for causing the recording means to correlatively scan with respect to the recording material; and head driving means for driving the recording means for printing on the recording material during the correlative scan of the recording means by the scanning means, comprising:

scanning speed setting means for setting and changing scanning speeds of the scanning means;

determining means for determining recording areas and non-recording areas on the recording material in accordance with the printing data; and controlling means for controlling said scanning speed setting means in accordance with the printing data to control the scanning speeds of the scanning means in a recording area determined by said determining means, in accordance with a distance between a position to start scanning and a position to start recording on the recording material within an area scanned by the scanning means, wherein, in a case where a non-recording area during a single scan of the recording means is equal to or more than a predetermined amount, said controlling means controls said scanning speed setting means so as to raise the scanning speed in the non-recording area and, in a case where the non-recording area is less than the predetermined amount, controlling is executed so as not to change the scanning speed in the non-recording area, and wherein said controlling means controls said scanning speed setting means based on a position to finish recording for a previous scanning, a position to start recording for a following scanning and an amount of a recording area in the following scanning.

19. A recording apparatus according to claim 18, further comprising:

driving control means for driving the recording means to record an image in accordance with the scanning speeds set by said scanning speed setting means.

20. A recording apparatus according to claim 18, wherein said determining means determines recording areas and non-recording areas within a recording range of the recording material in accordance with printing data during one scan.

21. A recording apparatus according to claim 18, further comprising:

means for preparing a table of scanning speeds of the scanning means during one scan in accordance with a determination by said determining means, wherein said controlling means controls the scanning speeds of the scanning means in accordance with the table.

22. A recording apparatus according to claim 18, wherein said controlling means controls the scanning speeds of the scanning means in accordance with recording areas and non-recording areas determined by said determining means within a recording range of the recording material.

23. A recording apparatus according to claim 22, wherein said determining means makes a determination in accordance with printing data corresponding to the recording areas scanned plural times, and said controlling means controls scanning speeds in accordance with recording areas and non-recording areas scanned plural times and determined by said determining means.

24. A recording apparatus according to claim 18, wherein the recording means is provided with discharge ports to discharge ink, and discharge means for discharging ink from the discharge ports to print by discharging ink onto the recording material.

25. A recording apparatus according to claim 24, wherein the discharge means comprise electrothermal transducing elements that apply thermal energy to ink to cause a change of state of the ink to discharge the ink.

26. A method for controlling scanning speeds of a recording apparatus provided with recording means for printing on a recording material in accordance with received printing data; scanning means for causing the recording means to correlatively scan with respect to the recording material; and head driving means for driving the recording means for printing on the recording material during the correlative scan of the recording means by the scanning means, comprising the following steps of:

determining a recording area, a non-recording area and an amount of the non-recording area in an area where the recording means is scanned by the scanning means based on the printing data;

setting scanning speeds of the scanning means in accordance with a determination in said determining step, the scanning speeds being set in accordance with a distance between a position to start scanning and a position to start recording on the recording material in a scanning range of the scanning means, wherein, in a case where the amount of the non-recording area is equal to or more than a predetermined amount during a single scan of the recording means, the scanning speed in the non-recording area is raised in said setting step and, in a case where the amount of the non-recording area is less than the predetermined amount, the scanning speed is not changed in the non-recording area, and wherein said setting step sets the scanning speeds based on a position to finish recording for a previous scanning, a position to start recording for a following scanning and an amount of a recording area in the following scanning; and recording by driving the recording means in accordance with the scanning speeds set in said setting step.

27. A method for controlling scanning speeds according to claim 26, wherein said determining step determines recording areas and non-recording areas within the scanning range of the recording material in accordance with printing data during one scan.

28. A method for controlling scanning speeds according to claim 26, further comprising the step of:

preparing a table of scanning speeds of the scanning means during one scan in accordance with the results of a determination in said determining step, wherein the scanning speeds of the scanning means are controlled in accordance with the table in said setting step.

29. A method for controlling scanning speeds according to claim 26, further including the step of providing the recording means with discharge ports to discharge ink, and providing discharge means for discharging ink from the discharge ports to print by discharging ink onto the recording material.

30. A method for controlling scanning speeds according to claim 29, wherein the discharge means comprise electrothermal transducing elements that apply thermal energy to ink to cause a change of state of the ink to discharge the ink.

31. A recording apparatus provided with recording means for printing on a recording material in accordance with received printing data; scanning means for causing the recording means to correlatively scan with respect to the recording material; and head driving means for driving the recording means for printing on the recording material during the correlative scan of the recording means by the scanning means, said apparatus comprising:

judging means for judging a printing area where a printing image exists in an area where printing is performed by scanning the recording means by said scanning means; and controlling means for controlling the scanning means based on a judgement result of said judging means, wherein said controlling means controls said scanning means so as to accelerate to a first scanning speed between a scanning start position and a print start position, and to a second scanning speed higher than the first scanning speed in a non-printing area, between a printing area and a subsequent printing area, where a printing image does not exist after the print start position, wherein acceleration to the second scanning speed is performed in a case the non-printing area is at least equal to a predetermined amount, and wherein the first scanning speed is determined based on an amount of area where printing is performed.

32. A recording apparatus according to claim 31, further comprising:

driving control means for driving the recording means to record an image in accordance with the scanning speeds set by said controlling means.

33. A recording apparatus according to claim 31, wherein said judging means judges the printing areas and the non-printing areas within a printing range of the recording material in accordance with printing data during one scan.

34. A recording apparatus according to claim 31, further comprising:

means for preparing a table of scanning speeds of the scanning means during one scan in accordance with a judgement by said judging means, wherein said controlling means controls the scanning speeds of the scanning means in accordance with the table.

35. A recording apparatus according to claim 31, wherein the recording means is provided with discharge ports to discharge ink, and discharge means for discharging ink from the discharge ports to print by discharging ink onto the recording material.

36. A method for controlling scanning speeds of a recording apparatus provided with recording means for printing on a recording material in accordance with received printing data; scanning means for causing the recording means to correlatively scan with respect to the recording material; and head driving means for driving the recording means for printing on the recording material during the correlative scan of the recording means by the scanning means, said method comprising the steps of:

judging a printing area where a printing image exists in an area where printing is performed by scanning the recording means by the scanning means;

accelerating the scanning means in a first accelerating step to a first scanning speed between a scanning start position and a print start position based on a judgement result in said judging step, wherein the first scanning speed is determined based on an amount of area where printing is performed;

printing, subsequent to said first accelerating step, by scanning the recording means at the first scanning speed; and accelerating the scanning means in a second accelerating step to a second scanning speed higher than the first scanning speed in a non-printing area, between a printing area and a subsequent printing area, where a printing image does not exist after the print start position, wherein acceleration to the second scanning speed is performed in a case the non-printing area is at least equal to a predetermined amount.

37. A method for controlling scanning speeds according to claim 36, wherein said judging step determines the printing areas and the non-printing areas within a scanning range of the recording material in accordance with printing data during one scan.

38. A method for controlling scanning speeds according to claim 36, further comprising the step of:

preparing a table of scanning speeds of the scanning means during one scan in accordance with the judgment results in said judging step, wherein the scanning speeds of the scanning means are controlled in accordance with the table in said first and second accelerating steps.

39. A method for controlling scanning speeds according to claim 36, further including the step of providing the recording means with discharge ports to discharge ink, and providing discharge means for discharging ink from the discharge ports to print by discharging ink onto the recording material.

40. A method for controlling scanning speeds according to claim 36, wherein said first accelerating step accelerates the scanning means to a low speed in a case where an amount of printing area is less than a predetermined amount.

41. A recording apparatus according to claim 18, wherein said controlling means sets the scanning speed to a low speed in a case where an amount of recording area in the following scanning is lower than a predetermined amount.

42. A recording apparatus according to claim 31, wherein said controlling means sets the first scanning speed to a low speed in a case where an amount of printing area is less than a predetermined amount.

* * * * *

UNITED STATES PATENT AND TRADEMARK OFFICE

CERTIFICATE OF CORRECTION

PATENT NO. : 6,260,945 B1
DATED : July 17, 2001
INVENTOR(S) : Niikura

It is certified that error appears in the above-identified patent and that said Letters Patent is hereby corrected as shown below:

Column 1,
Line 31, "the direction in" should read -- the direction intersecting --.
Line 51, "recording" should read -- (recording --.

Column 3,
Line 41, "a" should read -- ∝ --.

Column 5,
Line 39, "example" should read -- example of --.

Column 6,
Line 20, "13:" should read -- 12: --.

Column 7,
Line 4, "cap" should read -- cap 22 --.

Column 8,
Line 50, "3B-C" should read -- 3B-C, --.

Column 10,
Line 26, "the.scanning" should read -- the scanning --.
Line 35, "$V_{xn+1}>V_{max}$" should read -- $V_{xn+1}>V_{max}$, --.
Line 38, "S11" should read -- S11, --.
Line 53, "images" should read -- image --.
Lines 57 and 58, should be merged into the same paragraph.

Column 11,
Line 31, "right.end" should read -- right end --.
Line 55, "6A-C" should read -- 6A-C, --.
Line 59, "25." should read -- 25 --.

Column 14,
Line 48, "As" should read -- As is --.

UNITED STATES PATENT AND TRADEMARK OFFICE

CERTIFICATE OF CORRECTION

PATENT NO. : 6,260,945 B1
DATED : July 17, 2001
INVENTOR(S) : Niikura

It is certified that error appears in the above-identified patent and that said Letters Patent is hereby corrected as shown below:

Column 15,
Lines 43-48, claim 6 should be deleted.

Column 16,
Lines 46-52, claim 15 should be deleted.

Signed and Sealed this

Ninth Day of April, 2002

*Attest:*

*Attesting Officer*

JAMES E. ROGAN
*Director of the United States Patent and Trademark Office*